United States Patent [19]

Quick

[11] Patent Number: 4,689,452

[45] Date of Patent: Aug. 25, 1987

[54] CENTRIFUGAL BALL SWITCH

[75] Inventor: David C. Quick, Rockford, Ill.

[73] Assignee: Sundstrand Corporation, Rockford, Ill.

[21] Appl. No.: 896,494

[22] Filed: Dec. 16, 1986

[51] Int. Cl.[4] ..... H01H 35/10

[52] U.S. Cl. ..... 200/80 R; 310/68 E; 73/551

[58] Field of Search ..... 310/68 E; 200/80 R; 318/462, 793; 307/120; 73/535, 537, 551

[56] References Cited

U.S. PATENT DOCUMENTS

| | | | |
|---|---|---|---|
| 2,598,481 | 5/1952 | Young | 200/80 R |
| 2,775,665 | 12/1956 | Harstick | 200/80 R |
| 2,863,655 | 12/1958 | Frederick | 73/551 |
| 2,865,475 | 12/1958 | MacMillin | 73/530 |
| 3,176,522 | 4/1965 | Quenneville | 200/80 R |
| 4,107,483 | 8/1978 | Jouret | 200/80 R |
| 4,377,731 | 3/1983 | Georgelin | 200/80 R |

*Primary Examiner*—G. P. Tolin

*Attorney, Agent, or Firm*—Harold A. Williamson; James A. Wanner; William D. Lanyi

[57] ABSTRACT

The invention is directed to a rotational speed sensing switch which provides a variable linear displacement of an output member in response to a varying speed rotational input. The switch includes a sensing means, which includes a rotatable rolling element-and-ramp assembly, acting in cooperation with a signaling means which includes an axially movable actuating disc, an output member comprising a switch rod, and a biasing means. The aforementioned improvement over the prior art comprises a regulating means included within the sensing means.

16 Claims, 12 Drawing Figures

CENTRIFUGAL BALL SWITCH

This invention relates to centrifugal speed governors. More particularly the invention relates to centrifugal speed governors for preventing overspeeding of rotating turbomachinery by actuating a power cutoff or torque disconnect switch at a predetermined speed.

BACKGROUND ART

Centrifugal speed governors which produce a linear movement of an output member in response to movement of a sphere acting under centrifugal force are not new, as is evidenced by U.S. Pat. No. 2,775,665 to William H. Harstick. The Harstick governor includes a rotatable hollow casing having diverging inner tapering walls and a plurality of spheres placed in rolling contact with the diverging inner tapering walls. As is best shown by FIG. 1, the diverging inner tapering walls 35 cooperate with spherical members 37 and 38, and converging inner tapering walls 25 of plunger 27 such that movement of the spherical members 37 and 38 under centrifugal force will cause plunger 25 to be moved axially away from cylindrical casing 11. The Harstick invention does not provide, as does the invention described hereinafter, a rotatable hollow casing having multi-gradient inner tapered surfaces which cause an output member to undergo a slow linear movement in response to rotational speed less than or equal to a certain speed and undergo a rapid linear movement in response to rotational speeds which exceed a certain speed.

A typical centrifugal speed governor of the prior art is set forth in simplified form in U.S. Pat. No. 2,598,481 to Young. As is best seen in FIG. 3, the Young governor includes a cup-shaped holder 35 which is fixed for rotation upon a driven shaft 45. Holder 35 has formed within its interior a dished track 37 in which a number of flyballs 36 freely ride. As is apparent from FIG. 3, rotation of the holder 35 will cause flyballs 36 to move outward along dished track 37 until the flyballs 37 begin to push against and move longitudinally slidable member 38, such that displacement of the slidable member 38 will proceed gradually as rotational speed increases, until such time as either member 38 or flyballs 36 can be displaced no further (see FIG. 4). The Young invention does not provide a sudden, sharply defined displacement of an output member in response to a specified rotational speed, as does the invention described hereinafter.

Also included within the background art over which the subject invention is an improvement is the U.S. Pat. to D. M. MacMillin, No. 2,865,475. As is seen in FIGS. 1 and 2, the MacMillin invention includes a rotatable and axially movable cage 36 which is provided with arcuate radially extending slots 35 in each of which a ball 34 loosely resides. At a radially outward region of each slot 35 is disposed a control edge 38, ledge 39, and calibrating edge 40, whose arrangement is seen in FIG. 1 and enlarged in FIGS. 4 and 5. A ball control plate 30 having flat ball receiving surfaces 33 is mounted coaxially with cage 36 for rotation therewith, plate 30 being also axially fixed. The MacMillin invention provides for relative axial displacement between cage 36 and plate 30 when, as cage 36 and plate 30 begin to rotate, balls 34 move radially outward to control edge 38, at which point balls 34 contact surfaces 33 and thereby proceed to push cage 36 axially away from plate 30. The MacMillin invention does not provide, as does the subject invention, for an initial slow speed linear displacement of an output member in response to a sensed rotational speed less than or equal to a selected rotational speed and a final high speed linear displacement of an output member in response to a sensed rotational speed greater than a selected rotational speed.

Finally, the U.S. Pat. to Jouret, No. 4,107,483, shows the application of a typically configured speed governor within a movement of a timing apparatus. As shown in FIGS. 2 and 3, centrifugal mechanism, designated generally item 101, is seen to bring a pinion and pin switch 102 into intermittent engagement with timing wheel 12 and electrical contact assembly 103. Neither the Jouret invention or any of the aforementioned patents provides, as does the hereinafter described invention, for an economy of parts such that a centrifugal speed governor which actuates a power cutoff or torque disconnect is integrally located within a hub of a rotating work member, such as a planet gear which has a completely independent function.

DISCLOSURE OF INVENTION

This invention relates to a rotational speed sensing switch which provides a variable linear displacement of an output member in response to a varying speed rotational input. The switch includes a sensing means, which in turn includes a rotatable rolling element-and-ramp assembly, acting in cooperation with a signaling means which includes an axially movable actuating disc, an output member comprising a switch rod, and a biasing means. The aforementioned improvement over the prior art comprises a regulating means included within the sensing means.

The rolling element-and-ramp assembly is supported for rotation about an axis of rotation and receives a rotational input. The ramp comprises in part a regulating means comprising a multigradient ramp surface, with which a rolling element is in rolling contact. The rolling element is also in sliding contact with an axially movable actuating disc, which is supported for rotation with the rolling element-and-ramp assembly. The switch rod is affixed normally to the movable actuating disc. The axially movable actuating disc is biased into contact with the rolling element by a resilient means so that the actuating disc moves resistively when the rolling element, acting under centrifugal force, pushes against the actuating disc. The multigradient surface of the ramp regulates the speed at which displacement of the actuating disc occurs. As input rotational speed is increased up to a selected speed, the actuating disc is displaced slowly. As the input rotational speed exceeds the selected speed, the actuating disc is displaced rapidly. When the just described event occurs, the displacement of the actuating disc brings the rod into contact with a mechanical or electrical switch (forming no part of this invention) which causes a torque disconnect or other power cutoff to occur. As the input rotational speed decreases, as a result of the just described power cutoff, the actuating disc will return to its original position. Return displacement of the actuating disc will initially be gradual as the input rotational speed decreases, but will conclude rapidly when the input speed decreases to some predetermined rate.

It is therefore a primary object of this invention to provide a rotational speed sensing switch, which upon sensing a rotational speed in excess of a selected speed, causes an output member to undergo a rapid linear displacement to actuate a power cutoff switch, but at rotational speeds less than or equal to the selected speed causes the output member to undergo a slow speed, non-actuating linear displacement.

It is another object of this invention to provide a rolling element-and-ramp type rotational speed sensing switch which has a ramp having a multigradient surface.

It is a further object of this invention to provide a rotational speed sensing switch which is constructed as an integral part of a work member, such as a gear, which has a function independent of the rotational speed sensing switch.

In the attainment of the foregoing objects, the invention contemplates the provision of a rotational speed sensing switch, which switch is capable of sensing accurately a preselected rotational speed and providing, as a response, a linear displacement of an output member. The switch includes an input shaft which has an axis of rotation, and a cylindrical switch housing which is fixed to an end of the shaft and rotates with it. A sensing means, which includes a rolling element-and-ramp assembly, is located within a cavity in the switch housing. Also located within the housing is a signaling means which includes a retaining disc, an axially movable actuating disc, an axially movable output member, and a resilient means.

The cylindrical switch housing cavity has an opening in an end face opposite that where the housing joins the input shaft. The cavity is divided into two regions, a cylindrical region located in the vicinity of the opening and a ramp channel region located remotely from the opening. The retaining disc, which has a central aperture, is located in the cavity near the opening. The actuating disc is also located in the cavity, in the cylindrical region between the retaining disc and the ramp channel region. The resilient means is located between the actuating disc and the retaining disc, and tends to force the actuating disc in the direction of the ramp channel region. The axially movable output member is a switch rod, concentrically passing through, and affixed to, the actuating disc, and which extends normally away from the disc and has an end which passes through the aperture in the retaining disc.

Also located within the housing cavity, specifically within the ramp channel region, is the sensing means, which includes the following combination of items. One or more ramp channel spaces are located in the ramp channel region. Each ramp channel space is defined in part by a pair of ramp channel side surfaces, which are perpendicular to the actuating disc. Also defining each ramp channel space is a multigradient ramp surface. The multigradient ramp surface, which functions as a regulating means, is generally inclined at an angle relative to the input shaft axis of rotation. Each ramp channel space is further bounded by the actuating disc and by a sleeve disposed on an end of the switch rod. A rolling element is placed within each ramp channel space, in abutting contact with each surface which bounds the space.

In the preferred embodiment of the invention, the housing and input shaft are formed as part of a gear hub. The rolling elements are spheres. The resilient means is a compressed helical spring. Each multigradient ramp surface includes a first, radially inward portion that is inclined at a steep angle relative to the axis of rotation, and a second, radially outward portion that is inclined at a gradually sloping angle to the axis of rotation. The multigradient ramp surface and actuating disc and spring permit, at rotational speeds equal to or less than a selected speed, only slow movement by the spheres radially outwardly along the ramp surfaces. As the rotational input speed exceeds the selected speed, the spheres are able to move rapidly to radially outwardmost positions in the second radially outward portion and cause an actuating displacement of the switch rod.

Other objects and advantages of the present invention will be apparent upon reference to the accompanying description when taken in conjunction with the following drawings:

BEST MODE FOR CARRYING OUT THE INVENTION

Figure 1:
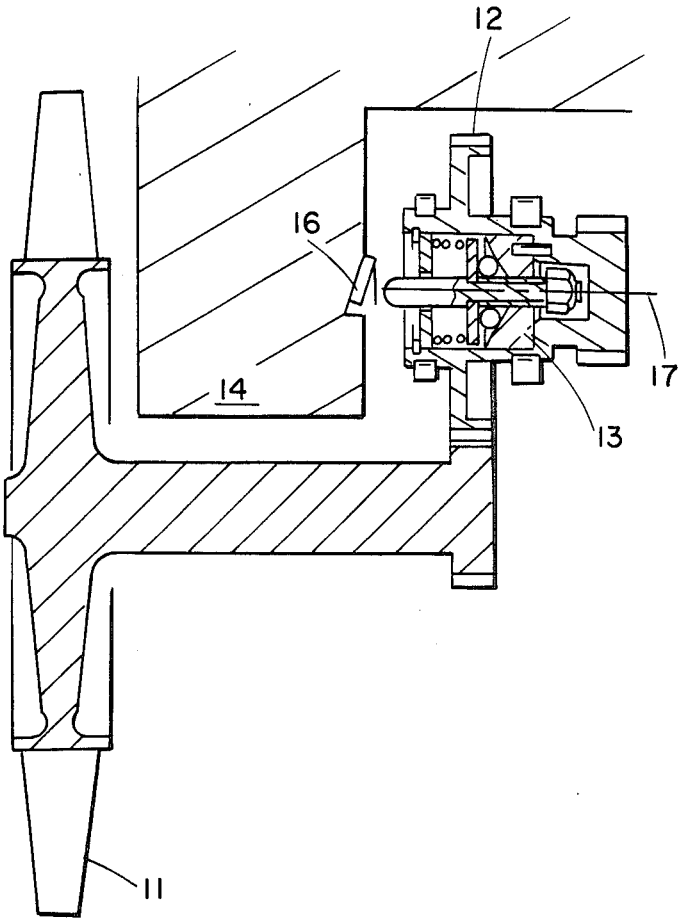
FIG. 1 is a sectional view of a turbine wheel drivingly connected to a gear which includes a centrifugal ball switch embodying the present invention.

Reference is now made to FIG. 1 which illustrates the invention in its preferred environment. A turbine wheel 11 drives a gear train (partially shown), of which planet gear 12 forms part. Rotation of the planet gear 12 in which a centrifugal ball switch 13 is secured, rotates at a speed directly proportional to the speed of the turbine wheel 11. Centrifugal ball switch 13 located within the hub of planet gear 12, which gear is mounted for rotation within casing 14, a portion of which is shown, Opposite the centrifugal ball switch 13 is an electrical contact 16. Centrifugal ball switch 13, upon overspeeding of the turbine wheel 11, causes in a manner hereinafter described the closing of electrical contact 16 to actuate a torque disconnect or other power cutoff (not shown).

Figure 2:
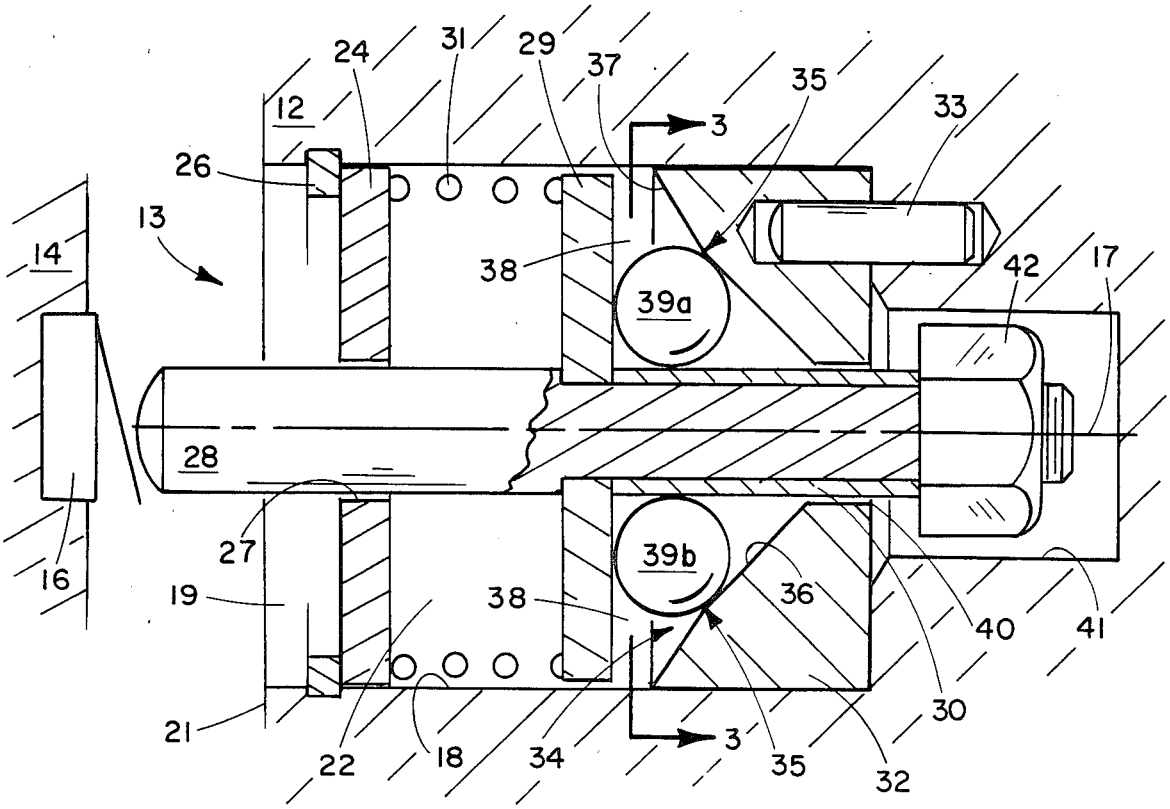
FIG. 2 is an enlarged sectional view of the centrifugal ball switch of FIG. 1, which embodies the invention and is shown at rest.

Attention is directed to FIG. 2, which shows an enlarged sectional view of the hub of gear 12, including centrifugal ball switch 13, and electrical contact 16, which is mounted in casing 14. Switch 13 is mounted within gear 12 for rotation about the gear's axis of rotation 17. Switch 13 occupies a generally cylindrical cavity 18 within the hub gear 12. Cavity 18 has an opening 19, as indicated by the associated lead line and arrow, in gear end face 21, and has two regions, a cylindrical region 22 and a ramp channel region as indicated in FIG. 2. Located within cylindrical region 22 and fixed against axial movement is a retaining disc 24. Retaining disc 24 is held in place by a snap ring 26.

Retaining disc 24 has a central aperture 27, through which switch rod 28 freely passes. Switch rod 28 is fixed to axially movable actuating disc 29 by sleeve 30, so that if actuation disc 29 is moved to the left, as seen in FIG. 2, switch rod 28 is constrained to also move to the left. Between retaining disc 24 and axially movable actuating disc 29 there is located a compressed helical spring 31 which constitutes a resilient means. Spring 31 tends to force actuating disc 29 towards the right as seen in FIG. 2.

A ramp channel insert 32 is placed within the ramp channel region noted above and secured to gear 12 by a pin 33. Ramp channel insert 32 has multigradient ramp surfaces 34, which include first radially inward steeply sloping regions 36 and second radially outward gradually sloping regions 37, which intersect to form arcuate actuation rims 35. Insert 32 also has a bore 40, which slideably accommodates switch rod 28. A hole 41 in the hub of gear 12 accommodates fastener/stop 42 in the form of a nut which is threadably secured to switch rod 28.

Switch rod 28, actuating disc 29 and ramp surfaces 34 define ramp channel spaces 38. Spheres 39*a* and 39*b* reside in the just defined ramp channel spaces 38 in abutting contact with switch rod 28, a side of actuation disc 29, and ramp surfaces 34.

Figure 3:
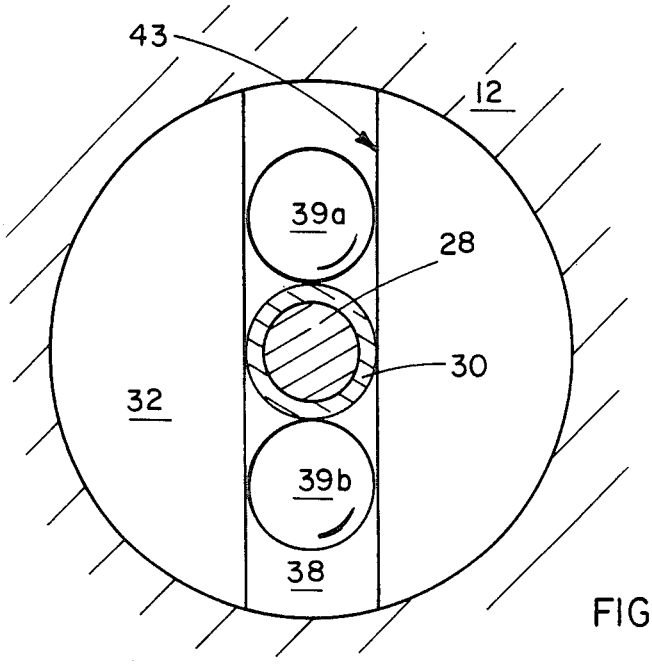
FIG. 3 is a view of the invention along the line 3—3 of FIG. 2.

As is seen in FIG. 3, the ramp channel spaces 38 are further bounded by ramp channel side surfaces 43. Reference is now made to FIGS. 5(*a*) to 5(*d*), which depict alternative ramp channel and actuation disc configurations. Hereinafter, like drawing reference numerals are used throughout the various views to designate corresponding parts, with primed numerals representing parts corresponding to alternative embodiments of the subject invention. FIGS. 5(*a*) and 5(*b*) depict ramp channel insert 32 and actuating disc 29 as they would appear in the preferred embodiment of the invention, with ramp channel side surfaces 43 as part of ramp channel insert 32.

Figure 7:
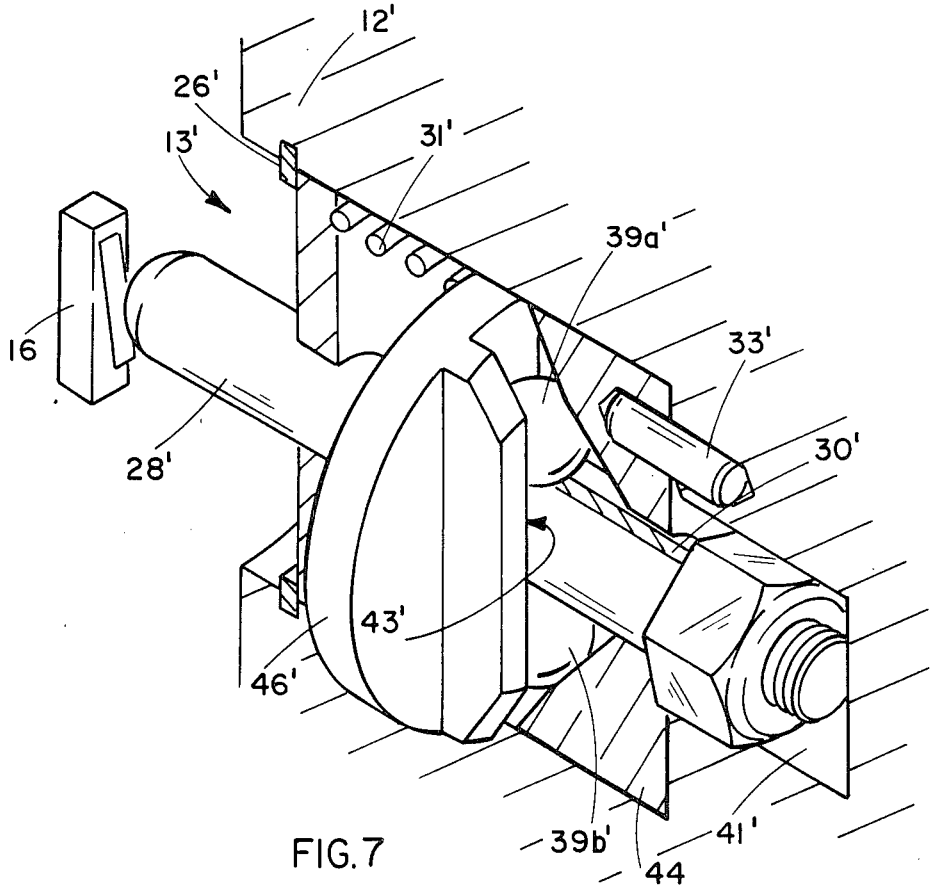
FIG. 7 depicts an isometric sectional view of the alternative embodiment of the invention.

An alternative embodiment, shown by FIGS. 5(*c*) and 5(*d*), is contemplated in which alternative insert 44 is a simple counter-bored plug and ramp channel side surfaces 43' are located on a modified actuating disc 46 as projections normal to it. Attention is directed to FIG. 7, which depicts an isometric sectional view of the just described alternative embodiment of the invention and highlights in particular the relationship between alternative insert 44, ramp channel side surface 43' and spheres 39(*a*)' and 39(*b*)'.

Figure 4:
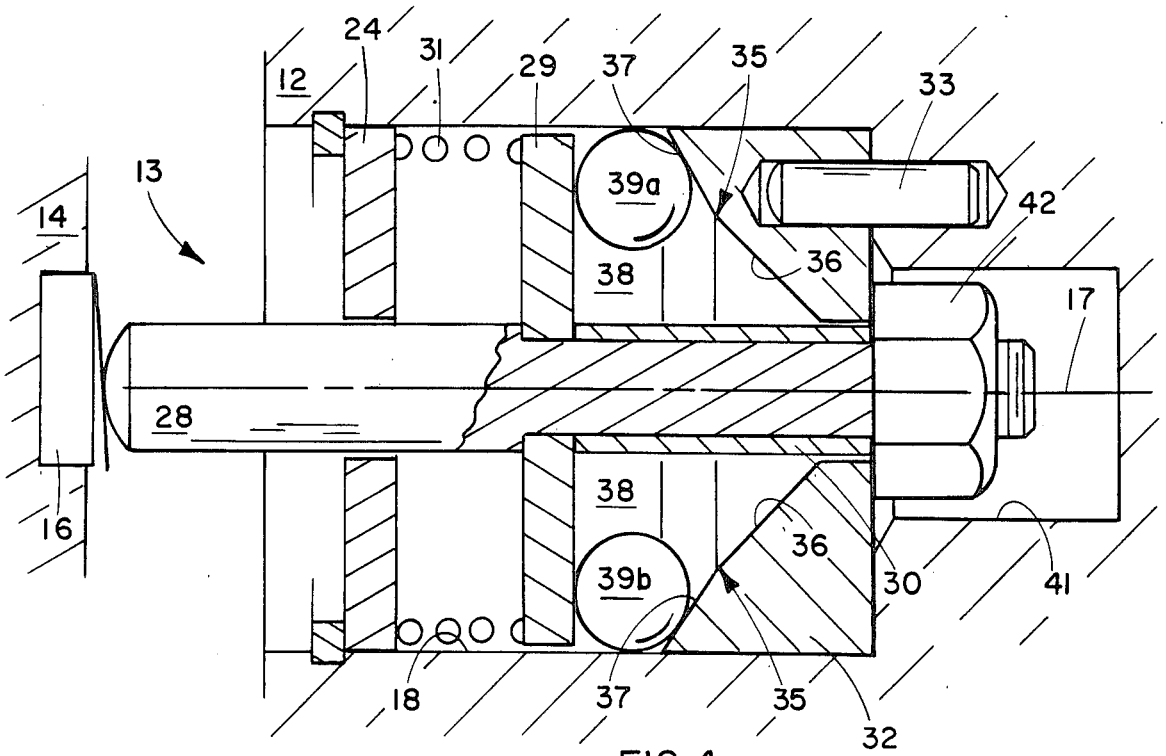
FIG. 4 is an enlarged sectional view of the centrifugal ball switch of FIG. 1, shown in an actuated position, FIG. 5(*a*) depicts a ramp channel insert of the preferred embodiment, FIG. 5(*b*) depicts an actuating disc of the preferred embodiment, FIG. 5(*c*) depicts a ramp channel insert of an alternative embodiment, FIG. 5(*d*) depicts an actuating disc of the alternative embodiment.

With reference to FIGS. 2, 3 and 4, the operation of the invention is elementary when gear 12 has a rotational speed of zero, FIG. 2 reflects the relative positions of the various components comprising the switch 13. Each sphere 39(*a*) and 39(*b*) is in rolling contact with a radially inward steeply sloping region 36 and in sliding contact with actuating disc 29 and switch rod 28. As the rotational speed of the gear 12 increases, centrifugal force acting upon the spheres 39 tends to cause the spheres 39(*a*) and 39(*b*) to roll radially outward along the first radially inward steeply sloping regions 36 of the ramp surfaces 34 towards the actuation rims 35. Spheres' 39(*a*) and 39(*b*) progress is yieldingly resisted by the spring 31, which biases the actuating disc 29 into continuous contact with the spheres 39(*a*) and 39(*b*), and is further compressed as actuating disc 29 is moved to the left, as seen in FIG. 2. The spring constant of spring 31 and the angle of inclination of the radially inward steeply sloping region 36 relative to the axis of rotation 17, are configured so that the spheres 39(*a*) and 39(*b*) will slowly arrive at the actuation rim 35 as the gear 12 achieves a critical rotational speed which is calculated to represent a selected maximum tolerable rotational speed for the turbine wheel 11 (see FIG. 1). So long as the gear 12 rotational speed does not increase, the spheres 39(*a*) and 39(*b*) will dwell at the actuation rims 35 in a state of equilibrium.

Any slight increase in gear 12 rotational speed, which would represent a turbine wheel 11 rotational speed in excess of that tolerable for any sustained period, will cause the spheres 39(*a*) and 39(*b*) to roll past the actuation rims 35 onto the radially outward gradually sloping regions 37 of the ramp surfaces 34.

Figure 8:
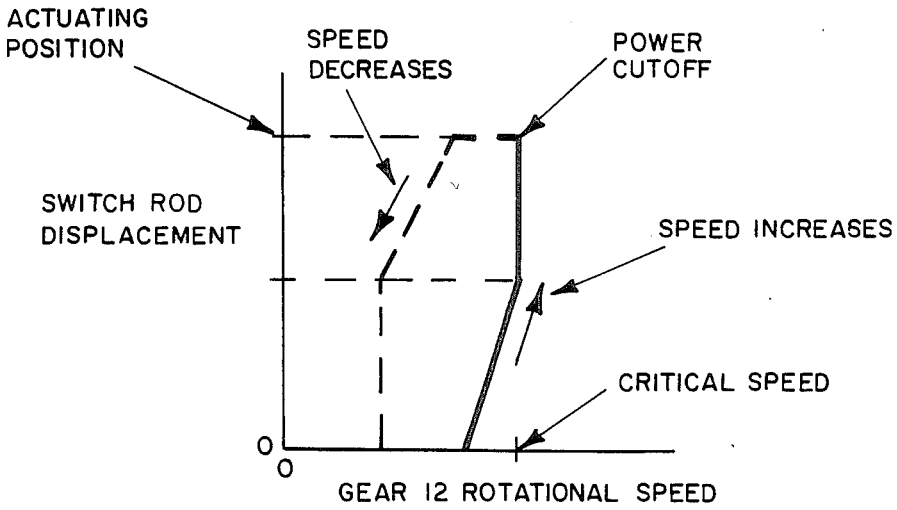
FIG. 8 is a graph which demonstrates the operation of the centrifugal ball switch as a function of rotational speed.

As the spheres 39(*a*) and 39(*b*) roll (or more precisely, pivot) around the actuation rims 35, the actuating disc 29 undergoes only an incremental displacement; the spring force exerted through the actuating disc 29 upon the spheres 39(*a*) and 39(*b*) will be approximately equal to that exerted when the spheres were radially inward of the actuation rim 35. However, since the surface 34 of the radially outward region 37 has a slope less steep than that of the adjacent radially inward region 36, the centrifugal force required to cause the sphere 39(*a*) and 39(*b*) to roll radially outward is less. Thus, as the spheres 39(*a*) and 39(*b*) pivot around the actuation rims 35 when the critical gear 12 rotational speed is exceeded, sudden imbalance of the forces acting upon the spheres 39(*a*) and 39(*b*) will develop, and the spheres 39(*a*) and 39(*b*) will roll almost instantaneously to radially outwardmost positions, shown in FIG. 4. As can be seen in FIG. 4, when the just described events occur, the switch rod 28, moving with the actuating disc 29 as it reaches the limit of its axial travel as defined by the positioning of fastener/stop 41, will actuate electrical contact 16, which will cause a power cutoff to be accomplished (not shown) so that the gear 12 rotation will be slowed or stopped. As the gear 12 rotational speed decreases, spheres 39(*a*), 39(*b*) will proceed to slowly roll radially inward along radially outward region 37, as spring 31 forces actuating disc 29 and switch rod 29 to the right. When the spheres 39(*a*), 39(*b*) reach the actuation rims 35, further decrease in the rotational speed of gear 12 will cause the spheres 39(*a*), 39(*b*) to rapidly pivot about the actuation rims 35 and proceed into the radially inward regions 36. Simultaneously with the just described event, actuating disc 29 and switch rod 28 will rapidly return to their respective initial positions as seen in FIG. 2. The just-described operation of the invention is graphically depicted in FIG. 8.

Figure 6:
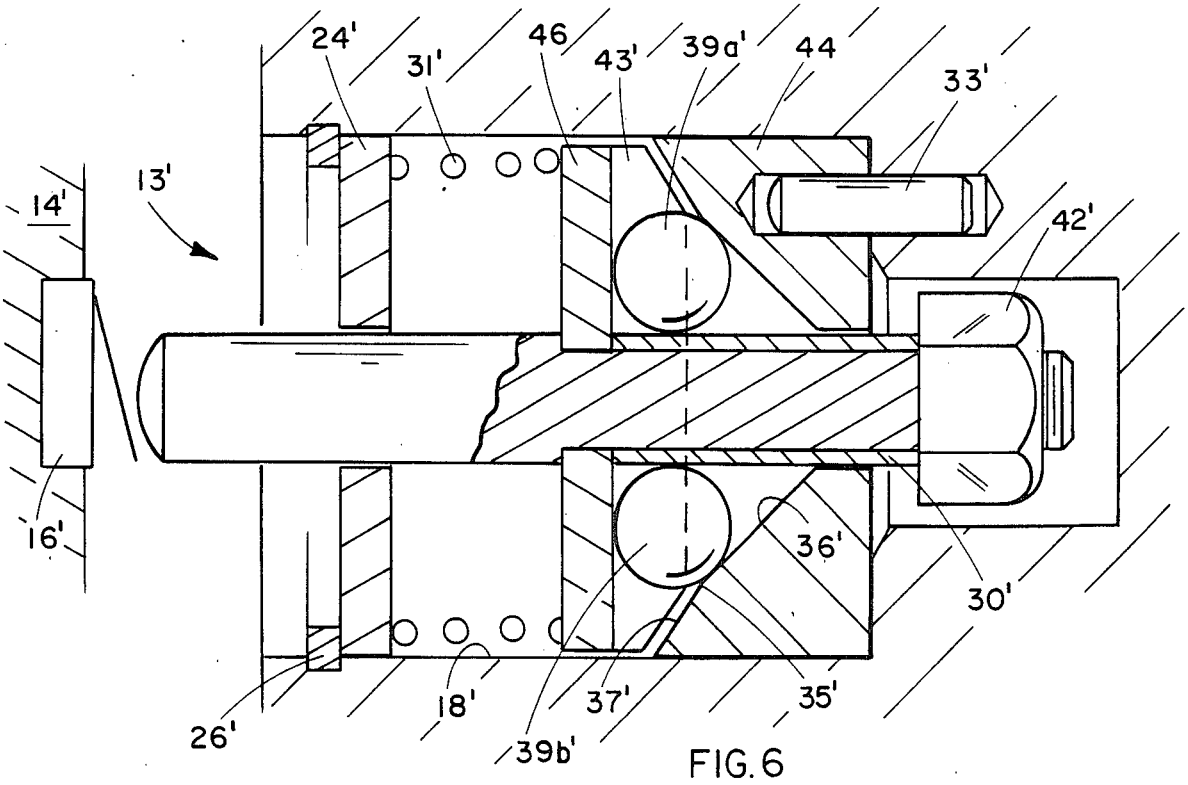
FIG. 6 depicts, in section, the alternative embodiment of the invention demonstrating the alternative ramp channel insert and actuating disc configuration.
Figure 5A:
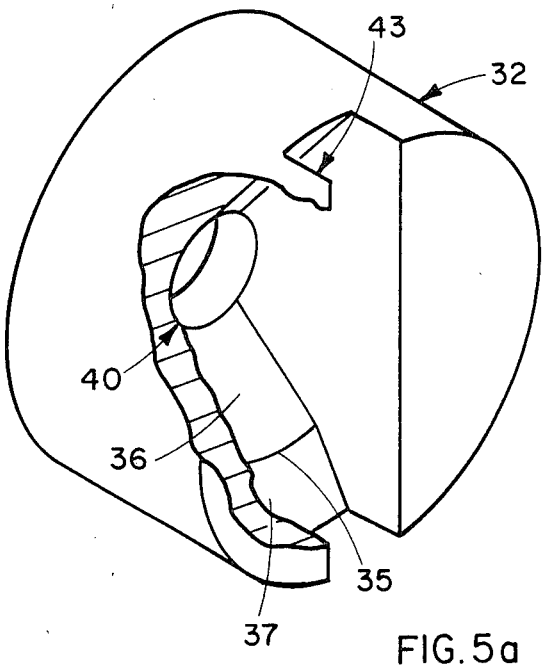
Figure 5B:
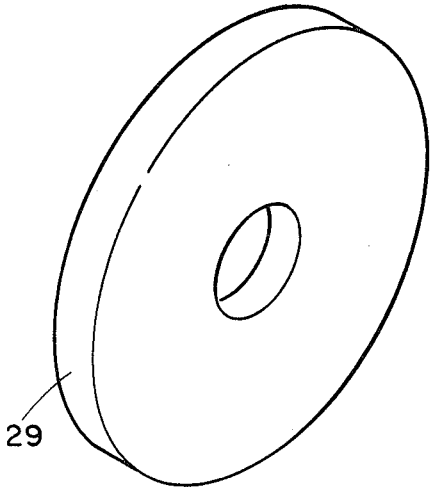
Figure 5C:
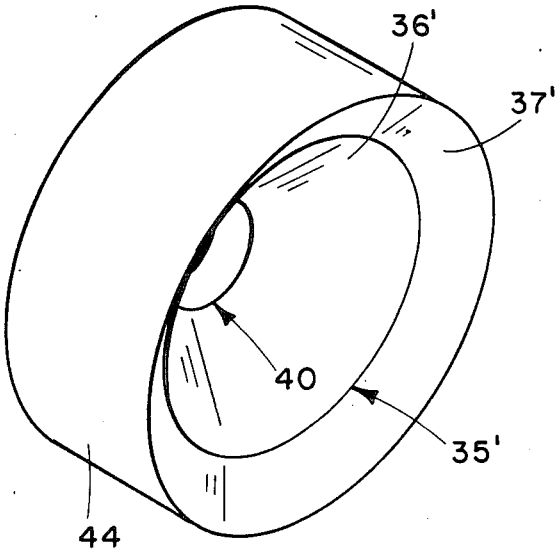
Figure 5D:
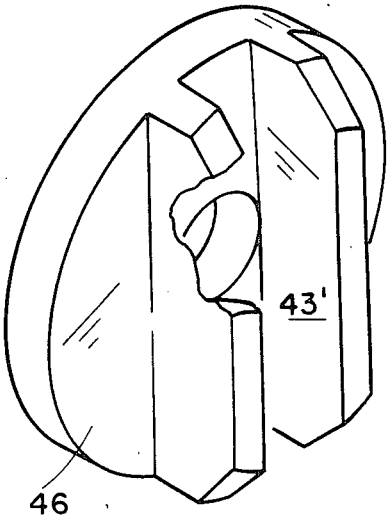
Figure 9:
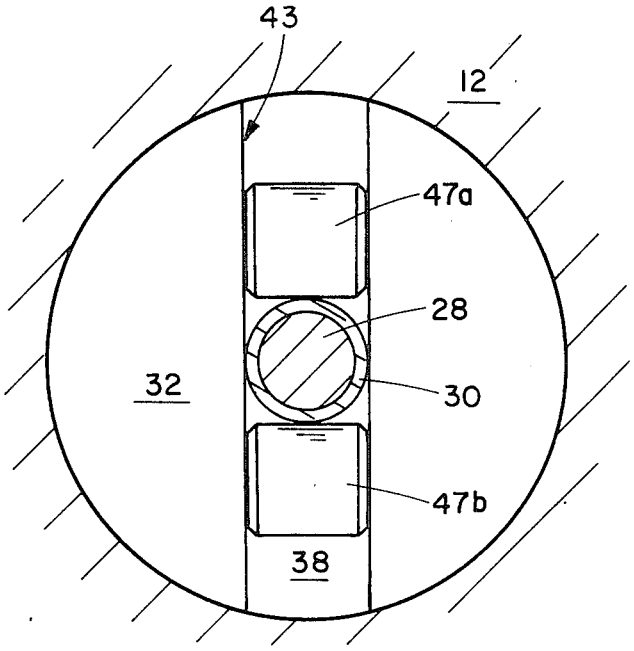
FIG. 9 is a section view of the invention which depicts the use of cylindrical rolling elements.

Attention is now directed to FIG. 6, which depicts an embodiment of the invention which employs the alternative ramp channel and actuating disc combination of FIGS. 5(*c*) and 5(*d*). The operation of the embodiment of the invention in FIG. 6 is in no way different from that just described. It is also contemplated that the spheres 39(*a*) and 39(*b*) utilized in the above described embodiments may be replaced with cylindrical rollers 47(*a*) and 47(*b*), as seen in FIG. 9, and still achieve the aforementioned objects of the invention.

Although this invention has been illustrated and described in connection with the particular embodiments illustrated, it will be apparent to those skilled in the art that various changes may be made therein without departing from the spirit of the invention as set forth in the appending claims.

I claim:

1. A rotational speed sensing switch apparatus including, in combination, a sensing means responsive to rotational input, said sensing means having an axis of rotation and including a regulating means, said sensing means having a rolling element subject to a displacement in response to said rotational input, said displacement having an axial component, a signaling means resistively responsive to said axial component of displacement of said element of said sensing means, said signaling means having an axially movable output member which undergoes a linear displacement equal, in speed and distance, to said axial component of displacement of said element of said sensing means, said regulating means including a multigradient ramp surface upon which said rolling element is displaced, said ramp surface comprising a first radially inwardly steeply sloping region and a second outwardly gradually sloping region, said regulating means cooperating with said signaling means to constrain said sensing means to provide slow speed displacements along said steeply sloping region of said regulating means of said element at rotational input speeds less than a selected rotational input speed, and said regulating means cooperating with said signaling means to constrain said sensing means to provide a rapid displacement of said element along said gradually sloping region of said regulating means of said sensing means when said rotational input speed exceeds said selected rotational input spped.

2. The rotational speed sensing switch of claim 1 wherein said rolling element is a cylinder.

3. The rotational speed sensing switch of claim 1 wherein said rolling element is a sphere.

4. The rotational speed sensing switch of claim 3 wherein said axially movable output member is a rod.

5. The rotational speed sensing switch of claim 4 wherein said signaling means includes an axially movable actuating disc, disposed in fixed relation to said rod.

6. The rotational speed sensing switch of claim 5 wherein said signaling means includes a retaining disc disposed in fixed relation to said sensing means.

7. The rotational speed sensing switch of claim 6 wherein said axially movable actuating disc is disposed between said sensing means and said retaining disc.

8. The rotational speed sensing switch of claim 7 wherein said axially movable actuating disc cooperates with a resilient means to resistively respond to said axial component of displacement of said element of said sensing means, said resilient means tending to force said axially movable disc toward said sensing means.

9. The rotational speed sensing switch of claim 8 wherein said resilient means is a compressed spring, disposed between said axially movable actuating disc and said retaining disc.

10. The rotational speed sensing switch of claim 9 wherein said sensing means, said regulating means and said signaling means are disposed within a cylindrical housing.

11. The rotational speed sensing switch of claim 10 wherein said cylindrical housing is disposed at one end of an input shaft and fixed for rotation therewith.

12. The rotational speed sensing switch of claim 11 wherein said cylindrical housing and said input shaft form part of a gear hub.

13. The rotational speed sensing switch of claim 12 wherein said sphere is in rolling contact with said ramp surface.

14. The rotational speed sensing switch of claim 13 wherein said ramp surface radially inward portion is steeply inclined relative to said axis of rotation and said radially outward portion is gradually inclined relative to said axis of rotation, said spring and said axially movable actuating disc cooperating with said surface to constrain said sphere to move slowly at rotational input speeds less than a selected rotational input speed, and to constrain said sphere to move rapidly when said rotation input speed exceeds said selected rotational input speed.

15. A rotational speed sensing switch apparatus including in combination.

an input shaft having an axis of rotation, variable gradient ramp means radially disposed relative to one end of said input shaft and fixed for rotation therewith, said variable gradient ramp means having a first radially inwardly steeply sloping surface and a second outwardly gradually sloping surface, centrifugal force responsive rolling means disposed in rolling contact with said first and second surfaces of said ramp means, axially movable actuating means disposed adjacent to said ramp means and fixed for rotation with said input shaft, said rolling means being disposed between said ramp means and said axially movable actuating means, said axially movable actuating means being biased axially toward said ramp means and being in sliding contact with said rolling means, said rolling means being disposed initially in a radially inward position in respect to said ramp means, whereby upon rotation of said input shaft, said rolling means is constrained by centrifugal force to roll radially along said first steeply sloping surface of said ramp means, said rolling means simultaneously causing said axially movable actuating means to be moved away from said ramp means, said first inwardly steeply sloping surface of said ramp means acting in cooperation with said rolling means to cause said axially movable actuating means to be slowly moved as input shaft rotational speed increases to a selected rotational speed, and said second outwardly gradually sloping surface of said ramp means acting in cooperation with said rolling means to cause said axially movable actuating means to be moved rapidly when said input shaft rotational speed exceeds said selected speed.

16. A rotational speed sensing switch apparatus including, in combination:

an input shaft having an axis of rotation, a cylindrical switch housing disposed coaxially with and in fixed relation to said input shaft, a cavity disposed axially in said cylindrical switch housing having an opening in an end face of said cylindrical switch housing opposite said input shaft, said cavity comprising two regions, a first cylindrical region disposed adjacent to said opening and a second ramp channel region disposed remotely from said opening, a retaining disc having an aperture disposed in its center, said retaining disc disposed within said first cylindrical region in fixed relation to said cylindrical switch housing, an actuating disc disposed within said first cylindrical region in axially movable relation with said cylindrical switch housing, said actuating disc being disposed in said first cylindrical region between said retaining disc and said ramp channel region, resilient means biasing said actuating disc axially away from said retaining disc, a switch rod disposed concentrically to and in fixed relation with said actuating disc, said switch rod passing through and extending axially beyond said aperture in said retaining disc in axially movable relation thereto, said switch rod extending axially from said actuating disc into said ramp channel region, said ramp channel region having a plurality of ramp channel spaces, each such ramp channel space comprising a region bounded by said actuating disc, said switch rod, a pair of parallel ramp channel side surfaces disposed normally to said actuating disc, and a multigradient ramp surface disposed at an angle to said axis of rotation, such multigradient ramp surface comprising a first radially inward steeply sloping region and a second radially outward gradually sloping region, and a plurality of spheres, one of such spheres being disposed in each said ramp channel space, in moveable relation to each surface defining said ramp channel space.

* * * * *